US010422567B2

(12) United States Patent
Grantham

(10) Patent No.: US 10,422,567 B2
(45) Date of Patent: Sep. 24, 2019

(54) CONDENSATE COLLECTION DEVICE

(71) Applicant: SCHNEIDER ELECTRIC IT CORPORATION, West Kingston, RI (US)

(72) Inventor: Roy L. Grantham, O'Fallon, MO (US)

(73) Assignee: SCHNEIDER ELECTRIC IT CORPORATION, West Kingston, RI (US)

( * ) Notice: Subject to any disclaimer, the term of this patent is extended or adjusted under 35 U.S.C. 154(b) by 814 days.

(21) Appl. No.: 14/984,326

(22) Filed: Dec. 30, 2015

(65) Prior Publication Data

US 2017/0191734 A1 Jul. 6, 2017

(51) Int. Cl.

| | |
|---|---|
| ***F25D 21/14*** | (2006.01) |
| ***F24F 13/22*** | (2006.01) |
| ***F28B 9/08*** | (2006.01) |
| ***F25D 23/00*** | (2006.01) |

(52) U.S. Cl.

CPC ..... *F25D 21/14* (2013.01); *F24F 13/222* (2013.01); *F25D 23/006* (2013.01); *F28B 9/08* (2013.01)

(58) Field of Classification Search

CPC ..... F25D 21/14; F25D 2321/14; F24F 13/22; F24F 13/222

See application file for complete search history.

(56) References Cited

U.S. PATENT DOCUMENTS

| | | | | |
|---|---|---|---|---|
| 5,410,891 | A | 5/1995 | Ripert | |
| 6,196,303 | B1 * | 3/2001 | Hepper | F24F 1/0007 165/111 |
| 6,363,736 | B1 | 4/2002 | Kunkel et al. | |
| 6,978,909 | B2 | 12/2005 | Goetzinger et al. | |
| 2007/0169493 | A1 * | 7/2007 | Rios | F24F 13/222 62/285 |
| 2008/0104988 | A1 * | 5/2008 | Lee | F24F 1/025 62/285 |

FOREIGN PATENT DOCUMENTS

| | | | |
|---|---|---|---|
| EP | 2921794 | A2 | 9/2015 |
| FR | 2679986 | A1 | 2/1993 |
| WO | 2012164289 | A1 | 12/2012 |

OTHER PUBLICATIONS

Extended European Search Report from corresponding European Application No. 16205183.3 dated Jul. 17, 2017.

* cited by examiner

*Primary Examiner* — Elizabeth J Martin
(74) *Attorney, Agent, or Firm* — Lando & Anastasi, LLP

(57) ABSTRACT

A condensate collection system for use in HVAC equipment configured to remove condensate from a coil assembly before unintentional release into the surrounding environment and increase energy efficiency by preventing substantial air mixing within the air conditioner itself. The condensate collection system comprising, a tray configured to collect condensate and a lid configured to both prevent the mixing of air and collect condensate, operatively connected by a plurality of standoffs attached to the base of the tray and the bottom of the lid wherein the lid is supported by the tray and the plurality of standoffs. The system further may include one or more condensate drain channels configured to collect and drain condensate from the top of the lid into the tray and subsequently drain from the tray through an exit port.

9 Claims, 13 Drawing Sheets

CONDENSATE COLLECTION DEVICE

BACKGROUND

Field of Invention

At least one embodiment of the present invention relates generally to condensate collection devices and more specifically to condensate collection systems for variable height coil assemblies for Heating, Ventilating, and Air Conditioning (HVAC) devices.

Discussion of Related Art

Heating, Ventilating, and Air Conditioning (HVAC) devices are used for a wide variety of climate control applications to regulate temperature or humidity levels of a particular environment such as a data center. During cooling operations of such HVAC equipment, condensation may form on the coils (for example evaporator coils) of an air conditioning unit depending on temperature and humidity levels of the environment. As hot air is drawn across the colder coils and heat extracted from the environment, condensate may form. This condensate generally flows down or off the coils depending on the coil orientation due to the force of gravity. This condensate may then be collected into a device such as a reservoir, to prevent damage to the surrounding environment or the coils themselves due to subsequent freezing of the condensate on the coils. Any such reservoir must be emptied periodically to avoid overflow and damage to the nearby environment, should the reservoir overflow.

It is advantageous to reduce the condensate levels on the coils to prevent any potential for freezing of the condensate and subsequent coil damage. It is also advantageous to collect the condensate as quickly as possible from the coils as relatively large condensate droplets may be formed as condensate is accumulated while it runs down the coil. As these increasingly large droplets fall the length of the coil, they become heavy, take flight, and may be expressed from the HVAC equipment along with the conditioned air. This effect of "water carry over" or "condenser blow-off" may put nearby sensitive equipment at risk if condensate is expressed before it is collected.

Finally, as a result of their construction, many condensate collection devices may allow for a mixing of conditioned and unconditioned air. Due to this mixing, the overall efficiency of the HVAC equipment may be reduced substantially as warm intake air from the entering air side is mixed with exiting cool air from the leaving air side. Eliminating any mixing air as a result of the construction of a condensate collection device will allow efficiency gains for the HVAC equipment.

SUMMARY

A first aspect is directed to a condensate collection device for use with an air conditioner coil assembly. The condensate collection device includes a tray configured to be mounted in a horizontal orientation adjacent to the air conditioner coil assembly to collect condensate. The tray includes a base defining a perimeter of the tray, and an exit port configured to allow condensate to exit. The collection device includes a lid configured to restrict air movement across the air conditioner coil assembly. The lid includes a top, a bottom, a front, a back, a condensate drain channel configured to collect and drain condensate from the top of the lid into the tray, a coil header port configured to accept a portion of the air conditioner coil assembly, and a coil frame port configured to accept a housing of the air conditioner coil assembly. The collection device also includes a plurality of standoffs coupled between the base of the tray and the bottom of the lid.

In the condensate collection device, the condensate drain channel may include a drain slot, opposed sides, and a trough, where the trough is an elongated slope extending from the front of the lid to the back of the lid, the drain slot located proximate to the back of the lid and open to the tray, the opposed sides of the condensate drain channel directed inward toward the trough.

In the condensate collection device, the lid may contain a plurality of condensate drain channels disposed horizontally along the top of the lid, and the condensate collection device may be composed of material that is anti-microbial. A back wall of the tray and the back of the lid may be operatively connected by a living hinge.

Another aspect is directed to a condensate collection system for use with an air conditioner coil assembly. The condensate collection system includes a first condensate collection device including a tray mounted in a horizontal orientation adjacent to the conditioner coil assembly and configured to collect condensate, the tray having a gravity assist exit port configured to allow condensate to drain, a lid disposed on top of the tray, and configured to restrict air movement across the air conditioner coil assembly, the lid having a condensate drain channel configured to collect and drain condensate from the top of the lid into the tray. The condensate collection system includes a condensate drain tube connected to the gravity assist exit port of the first condensate collection device, and a second condensate collection device including a tray mounted in a horizontal orientation adjacent to the air conditioner coil assembly configured to collect condensate; a lid disposed on top of the tray, and configured to restrict air movement across the air conditioner coil assembly, the lid having a condensate drain channel configured to collect and drain condensate from the top of the lid into the tray and an entrance port to receive condensate from the condensate drain tube.

In the condensate collection system, the second condensate collection device may be mounted beneath the air conditioner coil assembly, and the first condensate collection device may be mounted above the second condensate collection device. The first condensate collection device may further includes a coil header port configured to accept a portion of the air conditioner coil assembly, a coil frame port configured to accept a housing of the air conditioner coil assembly, and a plurality of standoffs attached to the tray and the lid, wherein the lid is supported by the tray and the plurality of standoffs. The second condensate collection system may further include a coil header port configured to accept a portion of the air conditioner coil assembly, a coil frame port configured to accept a housing of the air conditioner coil assembly, and a plurality of standoffs attached to the tray and the lid wherein the lid is supported by the tray and the plurality of standoffs.

Another aspect is directed to an air conditioner that includes a first air conditioner coil assembly configured to cool air, and a first condensate collection device. The first condensate collection device includes a tray configured to be mounted in a horizontal orientation below the first air conditioner coil assembly to collect condensate, a lid configured to restrict air movement across the first air conditioner coil assembly, the lid including a condensate drain channel configured to collect and drain condensate from a top of the lid into the tray, and a coil header port configured to accept a portion of the first air conditioner coil assembly.

In the air conditioner, the first condensate collection device may further includes a coil frame port configured to accept a portion of a housing of the first air conditioner coil assembly, and the first condensate collection device may further include a plurality of standoffs disposed between the tray and the lid, wherein the lid is supported by the tray and the plurality of standoffs. The air conditioner may further include a second air conditioner coil assembly disposed below the first condensate collection device and configured to cool air, and a second condensate collection device including a tray configured to be mounted in a horizontal orientation below the second air conditioner coil assembly to collect condensate, a lid configured to restrict air movement across the second air conditioner coil assembly, the lid including a condensate drain channel configured to collect and drain condensate from a top of the lid into the tray, and a coil header port configured to accept a portion of the air conditioner coil assembly. The second condensate collection device may further include a coil frame port configured to accept a portion of a housing of the second air conditioner coil assembly, and the second condensate collection device may further include a plurality of standoffs disposed between the tray and the lid, wherein the lid is supported by the tray and the plurality of standoffs. The air conditioner may further include a condensate drain channel fluidly connected between the first condensate collection device and the second condensate collection device.

BRIEF DESCRIPTION OF THE DRAWINGS

The accompanying drawings are not intended to be drawn to scale. In the drawings, each identical or nearly identical component that is illustrated in various figures is represented by a line numeral. For purposes of clarity, not every component may be labeled in every drawing. In the drawings.

DETAILED DESCRIPTION

This invention is not limited in its application to the details of construction and the arrangement of components set forth in the following descriptions or illustrated by the drawings. The invention is capable of other embodiments and of being practiced or of being carried out in various ways. Also, the phraseology and terminology used herein is for the purpose of descriptions and should not be regarded as limiting. The use of "including," "comprising," "having," "containing," "involving," and variations herein, are meant to be open-ended, i.e. "including but not limited to."

Embodiments of the invention provide a condensate collection device for use in an air conditioner system and configured to remove condensate from a coil assembly before unintentional release of liquid condensate into the surrounding environment which may damage the surrounding equipment. Further, the condensate collection device serves to increase energy efficiency and reduce further condensate by preventing substantial air mixing within the air conditioner itself through keeping the cooler output air from the leaving air side isolated from the warmer intake air from the entering air side.

During cooling operations of HVAC equipment, condensation may form on the coils (for example evaporator coils) of an air conditioning unit depending on temperature and humidity levels of the environment. As hot air is drawn across the colder coils and heat extracted from the environment, condensate may form. This condensate then generally flows down or off the coils depending on the coil orientation due to the force of gravity. This condensate may then be collected into a device such as a reservoir, to prevent damage to the surrounding environment or the coils themselves due to freezing. Any such reservoir must be emptied periodically to avoid overflow and damage should the reservoir overflow. The condensate collection device in accordance with the invention may be configured to be mounted in a substantially horizontal orientation below and adjacent to the air conditioner coil assembly. In this orientation, any condensate which forms on the air conditioner coil assembly, and flows down or off the coil will not suffer "water carry-over" or "condensate blow off." Condensate will flow directly on or into the condensate collection device from the coil assembly and not be expressed into the environment due to the high velocity air flow generated by the air conditioner. This will reduce or eliminate the risk of condensate mist being sprayed into surrounding surfaces or components, such as sensitive electronic equipment.

Figure 1:
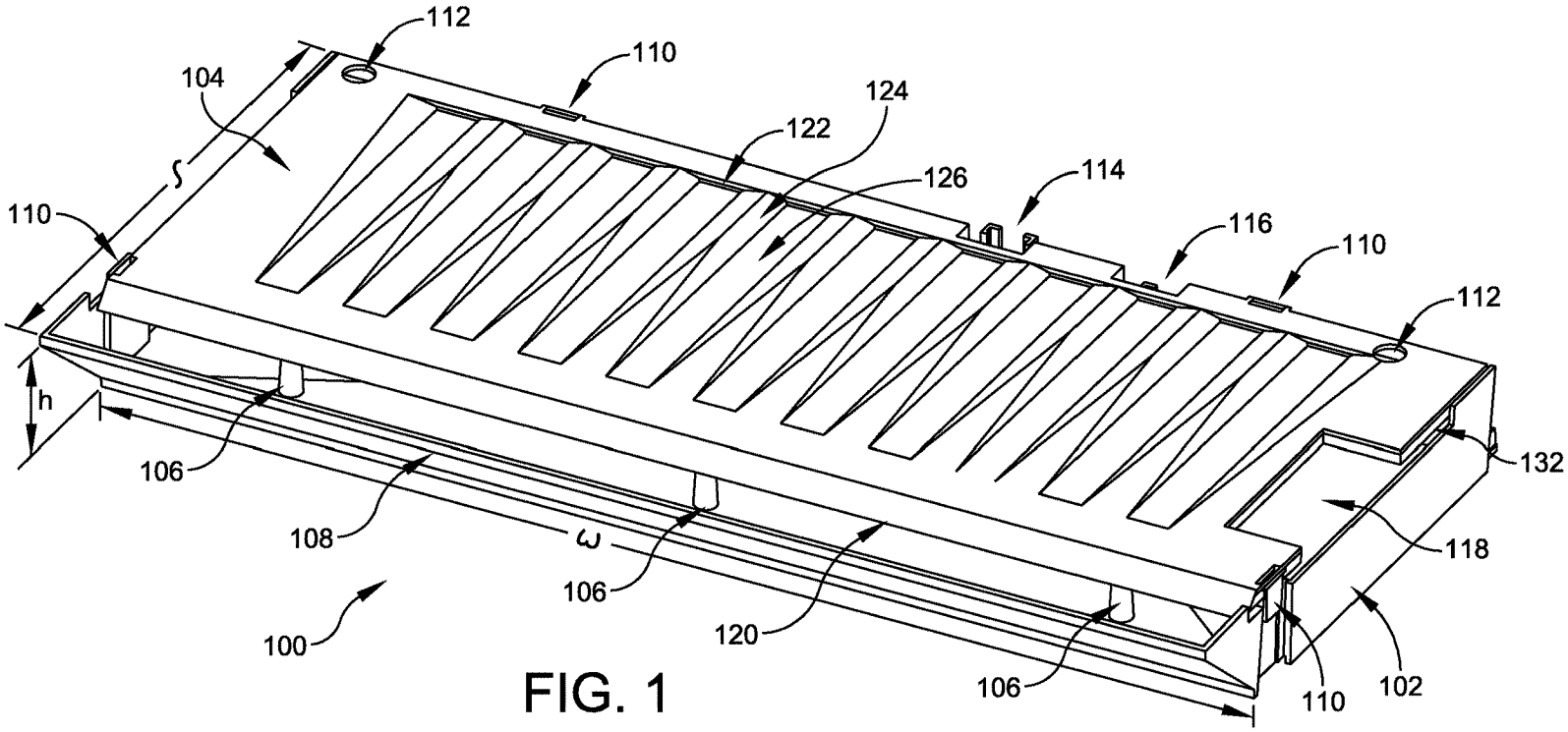
FIG. 1 is a perspective view of a system for a condensate collection device in accordance with an embodiment of the invention.

FIG. 1 is a perspective view of a condensate collection device 100 in accordance with an embodiment of the invention. Principles of the invention provide for a condensate collection device 100 which collects condensate from an air conditioner coil assembly before unintentional release of liquid condensate into the surrounding environment which may damage the surrounding equipment. Further, the condensate collection device 100 increases energy efficiency and reduces further condensate by preventing substantial air mixing within the air conditioner itself through keeping the cooler conditioned air output from the leaving air side isolated from the warmer air intake from the entering air side.

The condensate collection device 100 has a basic composition of a tray 102 configured to collect condensate, a lid 104 configured to restrict air movement across the air conditioner coil assembly as well as collect condensate, and a plurality of standoffs 106 to operatively connect or support the tray 102 to the lid 104.

The tray 102 includes a front wall, a back wall, opposed sides, and a base defining the perimeter of the tray 102. The tray 102 may have a generally rectangular shape with a width w, approximately the width of the air conditioner coil assembly to capture condensate produced by the coil assembly. The tray 102 may have a height h, sufficient to create a volume within the condensate collection device to contain condensate produced by the coil assembly for a period of time. The inner surface of the base of the tray may be configured to slope downward from the front wall to the back wall and from the left and right of the tray 102 to allow condensate to flow to an exit port (not shown in FIG. 1) while maintaining an outer surface of the base that is generally level to any support structure of the air conditioner unit.

The tray 102 may have a generally rectangular shape with a length l, approximately the length of the air conditioner coil assembly to capture a substantial amount of condensate produced by the coil assembly. This dimension l may extend beyond the length of the coil assembly to capture any condensate that does not fall into the condensate collection device parallel to the coil assembly. In various embodiments, the front wall may be constructed perpendicular to the base of the tray 102 or may be constructed at an angle as illustrated in FIG. 1 to collect condensate based on the various constructions of the coil assembly available in HVAC equipment. It should be appreciated principles of the invention allow the geometry of the tray to vary based on the particular application.

The tray 102 may also be constructed to have a plurality of tray latch assemblies 110 configured to operatively connect the tray 102 to the lid 104. Also assisting in securing or supporting the tray 102 to the lid 104 is a plurality of standoffs 106 to removably connect or support the tray 102 to the lid 104. Various embodiments of the invention allow for a tray 102, lid 104, and plurality of standoffs 106 which may be formed as a single condensate collection device 100 or separate components that may be assembled by a user of the condensate collection device 100. Other embodiments of the plurality of standoffs 106 may include attachment to the tray 102 or the lid 104. Further, it is possible both the tray 102 and the lid 104 have a plurality of standoffs 106 formed into them and when the tray 102 and lid 104 are assembled, form the plurality of standoffs 106. A wide variety of connection methods may be used, such as the tray latch assembly 110 shown in FIG. 1, a placement of the lid 104 on the plurality of standoffs 106, or the connection of the back wall of the tray and back of the lid by a "living hinge." Such a hinge may be a flexible joint which is generally composed of the same material of the mechanical components it connects. In one embodiment a living hinge may connect the tray 102 to the lid 104 using the same material. This joint may be thinned material, cut, or otherwise formed to allow a bend to occur along the hinge itself. Other embodiments while not a "living hinge," may include mechanical hinges composed of other materials and connected to both the tray 102 and the lid 104. This may allow the lid 104 to be opened to gain access to the tray, in one example, for cleaning, without separation of the lid 104 from the tray 102. In other embodiments, generic fasteners may be used to assemble the tray 102 and lid 104 together.

Principles of the invention may also allow for float switch mounting structures 114, 116 in the tray 102 to allow insertion of float switches used by various air conditioners. Such flow limit switches may be liquid level switches mounted horizontally skew from each other. One switch may act (the higher switch) as a high liquid level switch and the other (the lower switch) as a low liquid level switch. Such switches may provide an alarm or automatically activate a pump to drain condensate. Each float switch mounting structures 114, 116 may be identical or may be unique. While FIG. 1 illustrates two float switch mounting structures, corresponding to two float switches (not shown), one or more float switch mounting structures may be disposed on the back wall of the tray 102 to accommodate the number of flow limit switches available in the HVAC equipment.

To allow condensate from the housing of the coil assembly to be collected into the tray 102, a coil frame flange port 132 is configured to accept the coil frame flange and allow condensate to flow from the inside of the coil frame, directly into the tray 102 without condensate leaking outside of the condensate collection device 100. The coil frame flange port 132 is disposed on the opposed sides of the tray 102 and substantially parallel to the coil frame housing, above and adjacent to the condensate collection device 100.

The lid 104 includes a top, a bottom, a front, a back, a left side, a right side, and one or more condensate drain channels formed into the top of the lid 104. The lid 104 may have a generally rectangular shape with a width and a length approximately same as the tray 102 representative of the width and length of the air conditioner coil assembly. In various embodiments, the lid 104 may have a shorter length than the tray 102 it is operatively connected to. This would leave a portion of the tray 102 open creating a lid drain mouth 108 as illustrated in FIG. 1. In such a case, the front of the lid 102 may have a lid drain ramp 120 configured to drain any condensate formed on the lid 104 into the tray 102. Condensate may flow directly into the lid drain mouth 108 from the coil assembly as well as flow from the lid drain ramp 120 from the lid 104.

Each condensate drain channel may be formed in the top of the lid 104 and is configured to receive condensate from the coil assembly above condensate collection device 100 and drain into the tray 102. Each condensate drain channel may be formed into the top of the lid 104 and includes a drain slot 122, opposed sides 124, and a trough 126. The trough 126 is an elongated downward slope constructed from the front of the lid to the back of the lid, terminating in the drain slot 122. The drain slot 122 is located proximate to the back of the lid, and open to the tray 102 below to allow condensate to flow from the drain channel into the tray. The opposed sides 124 of the drain channel, slope inward toward the trough 126. The opposed sides 124 and the trough 126 operate to collect condensate from the lid 104 and conduct it to the drain slot 122 into the tray 102. While FIG. 1 illustrates eleven drain channels disposed into the top of the lid 104, in other embodiments, more or fewer drain channels may be disposed on the lid 104.

The lid 104 is configured to receive condensate from the coil assembly above the condensate collection device 100 and allow the condensate to flow into the tray 102 either directly into the lid drain mouth 108, the lid drain ramp 120, or via a condensate drain channel formed into the top of the lid 104. The lid is also configured to substantially prevent air mixing within the air conditioner by keeping the conditioned air output from the leaving air side isolated from the warmer air intake from the entering air side. The lid 104 is also configured to restrict air movement within the air conditioner. In typical prior art air conditioner systems, not all warm intake air is moved across the coil assemblies to be cooled. An amount of warm intake air from the entering air side may travel over the top or the bottom of the coil assembly and remain unconditioned. This unconditioned air when mixing with the colder conditioned air may form condensation, and without a method of collection, may be expressed from the air conditioning unit. Further, as warmer intake air from the entering air side is mixed with cooler conditioned air from the leaving air side, slightly warmer output air results, thereby degrading the efficiency of the overall air conditioner.

The condensate collection device 100 is configured to be mounted in a horizontal orientation adjacent to the air conditioner coil assembly creating an air blocking mechanism. This configuration reduces mixing of warm intake from the entering air side and cool conditioned air from the leaving air side, thereby preventing further condensate and raising the efficiency of an air conditioner having the condensate collection device 100.

The condensate collection device 100 may operatively connect to other condensate collection devices 100 or other generic condensate collection devices. To accommodate a drainage path from other condensate collection devices, the lid 104 may have one or more entrance ports 112 open to the tray 102. The entrance port 112 may be configured to accept a hose or any other suitable means of conveyance for condensate. It should be appreciated the entrance port 112 may be of any size or shape to accommodate such means of conveyance. Further, while FIG. 1 illustrates two such entrance ports 112, any number may be disposed at any place on the lid 104 to accommodate a particular application. In various embodiments, no entrance port 112 may be present, or may be pre-cut into the lid 104 and may be "knocked out" by an end user as necessary for a particular application thereby allowing configurability for multiple applications.

With the condensate collection device 100 mounted in a substantially horizontal orientation adjacent to the air conditioner coil assembly, portions of the coil assembly may come into contact with the lid 104. Further, portions of the coil assembly may protrude beyond the lid 104 into the tray 102. Any portion of the coil assembly that protrudes beyond the horizontal plane of the lid 104 may be inserted into a coil header port 118. Principles of the invention demonstrate the coil header port 118 may accept a portion of the coil assembly directly into the tray 102 to allow condensate that flows directly from the coil header to be collected into the tray 102 directly. It should be appreciated the coil header port 118 may be of any size or shape to accommodate such means of conveyance. Further, while FIG. 1 illustrates one such coil header port 118, any number may be disposed at any place on the lid 104 to accommodate a particular application. In various embodiments, no coil header port 118 may be present if the coil assembly does not have a protruding header, or may be pre-cut into the lid 104 and may be "knocked out" by an end user as necessary for a particular application thereby allowing configurability for multiple applications.

Each air conditioner coil assembly is generally contained and mounted by housing the coil assembly in pliable sheet metal or other such material. As part of typical operation of HVAC equipment, condensate may form not only on the coils but also on the housing of the coil assembly. Condensate may form and fall the length of the coil assembly housing and if not contained, may leak outside of the housing. Similar to condensate on the coils, relatively large condensate droplets may be formed as condensate is accumulated while it runs down the housing. As these increasingly large droplets fall the length of the coil, they become heavy, take flight, and may be expressed from the HVAC equipment along with the conditioned air. Similar to "water carry over" or "condenser blow-off" for the coils may put nearby sensitive equipment at risk if condensate is expressed before it is collected. To prevent this leaking, a coil frame port 132 exists in the condensate collection device 100 at the interface of the tray 102 and the lid 104 at one or both sides. Each coil frame port 132 is configured for the insertion of the coil frame housing into the coil frame port 132 to allow condensate collected on the interior of the coil frame housing to drain directly into the tray 104 to prevent any leaking of condensate.

As the condensate collection device 100 may retain condensate for periods of time, the composition of the device may be any material which suits that purpose. To reduce maintenance of the condensate collection device 100 it may be composed of or have added to the compositions an anti-microbial material to resist the growth of various microorganisms such as bacterium and fungi and the effects they cause such as mold. Composition of the condensate collection device 100 may also be composed of material that allows manufacturing such as various plastics for injecting molding. It should be appreciated that condensate collection device 100 may be manufactured as a single device or multiple pieces that may require various amounts of assembly into the device.

Figure 2:
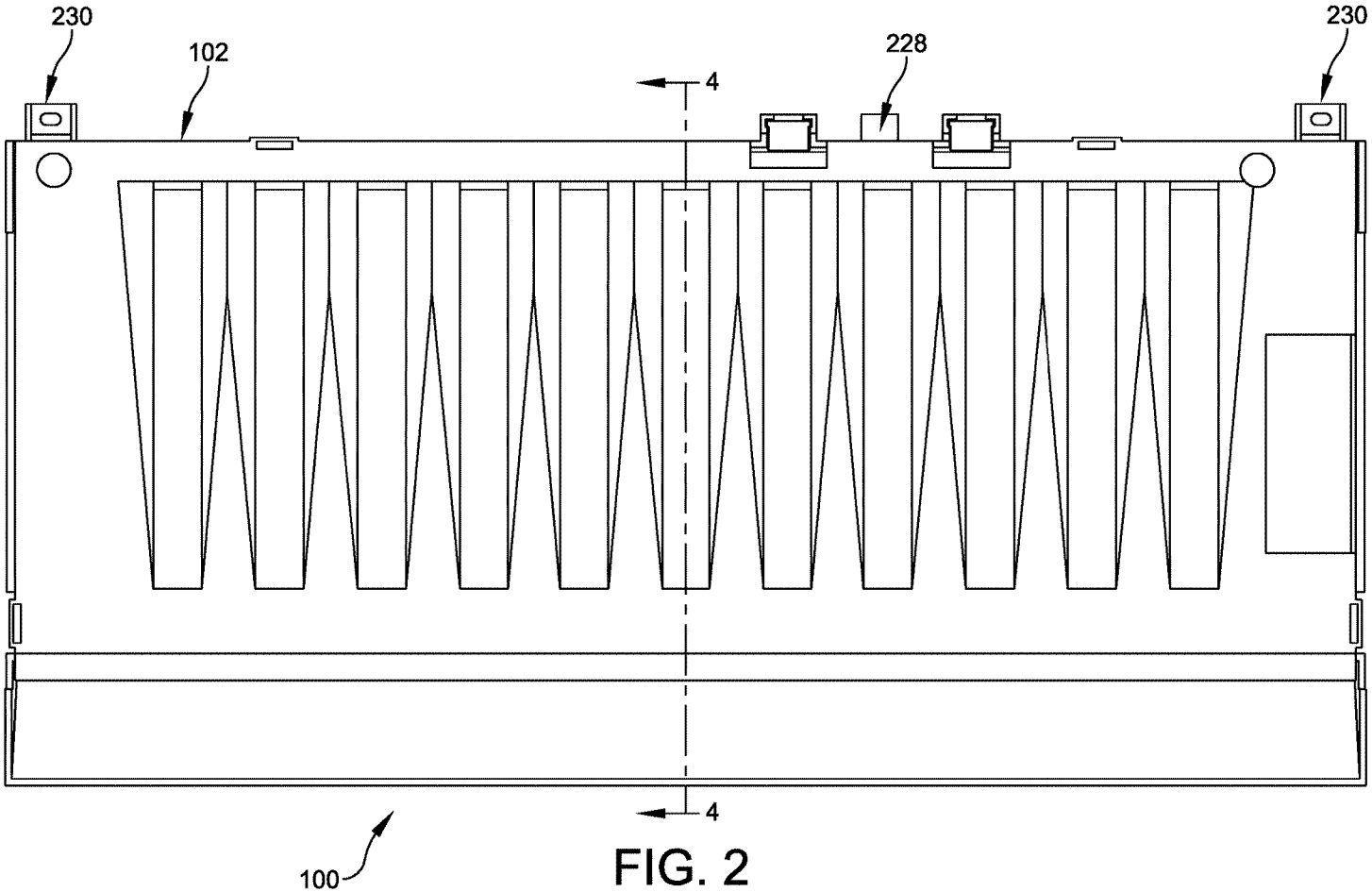
FIG. 2 is a top view of the system for a condensate collection device of FIG. 1.

FIG. 2 is a top view of the condensate collection device 100 of FIG. 1. As shown in FIG. 2 the condensate collection device also includes an exit port 228 formed into the tray 102. While FIG. 2 illustrates one exit port 228, one or more exit port 228 structures may be disposed on the back wall of the tray 102 to accommodate a particular application of draining condensate. It should also be appreciated the shape of the exit port 228 may vary based on the type of drain connection to the exit port 228. Various embodiments may allow for a ridged, tapered, or straight contour for the exit port 228 depending on the type of connection desired. It should be appreciated wide variability exists in connection types and media for draining condensate from the tray 102.

Mechanical support for the condensate collection device 100 may be accomplished by one or more tray frame mounts 230. While FIG. 2 illustrates two tray frame mounts 230, one or more tray frame mount structures may be disposed on the back wall of the tray 102 to accommodate a particular application. Further, tray frame mounts 230 may be disposed on each side wall or may be disposed to suit the particular application. Embodiments of the tray frame mount 230 may serve as a mounting bracket able to accept other mounting hardware such as a bolt, washer, and nut. Other embodiments may also include a tab which is operatively received by a mating slot in the air conditioner unit, creating a tool-less mounting option. It should be appreciated the tray frame mount 230 may not be necessary as the condensate collection device 100 may sit on a supporting shelf. Further, the tray frame mount 230 may be pre-cut into the tray 102 and may be "broken away" by an end user as necessary for a particular application thereby allowing configurability for multiple applications.

Figure 3:
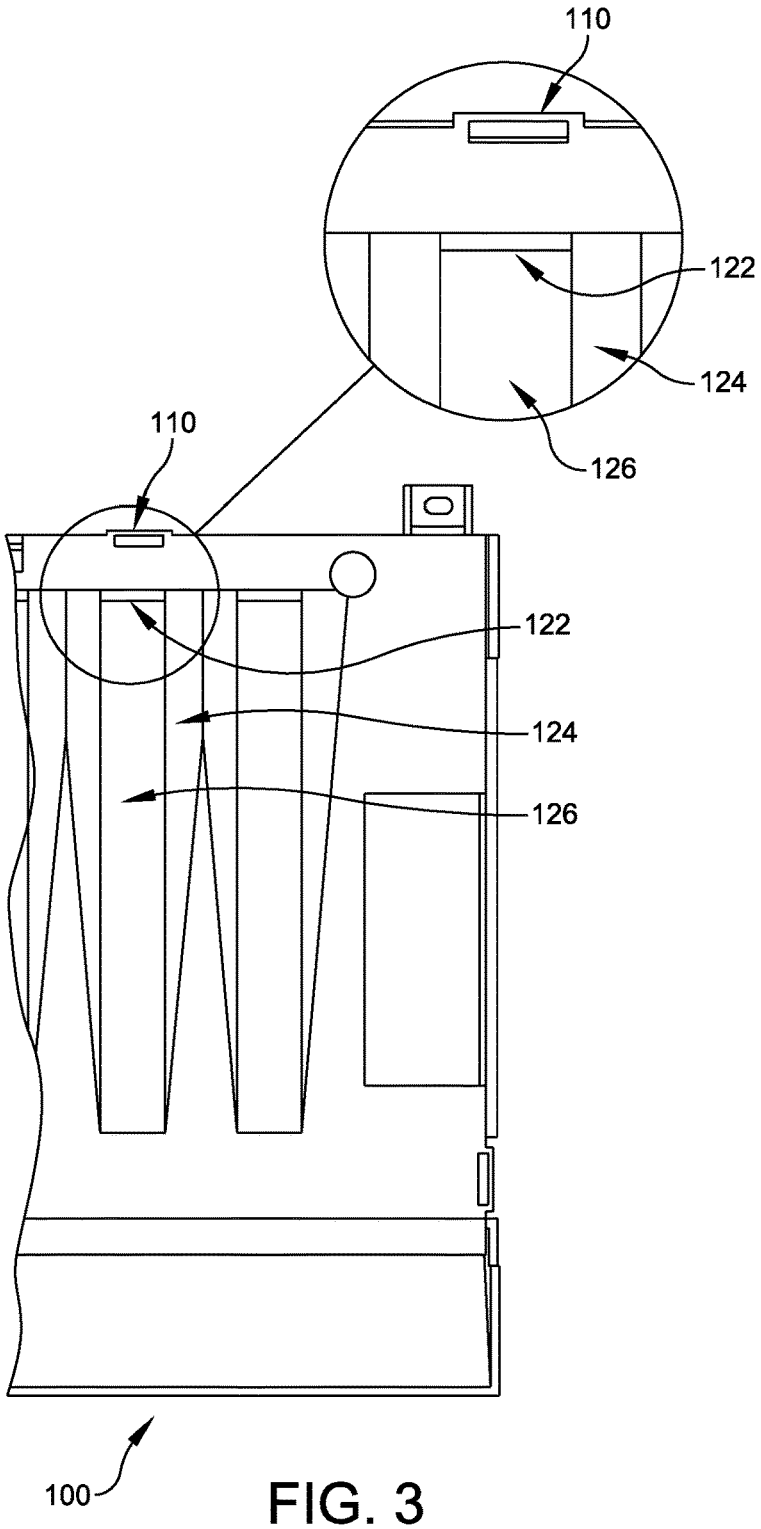
FIG. 3 is an exploded detail view of the system for a condensate collection device of FIG. 2.

FIG. 3 provides an exploded top view of structures discussed in detail supra, associated with FIGS. 1, 2 of the condensate collection device 100. Within the exploded top sectional view, the tray latch assembly 110 configured to operatively connect the tray 102 to the lid 104 is shown in greater detail. Further detail is also provided for the condensate drain channel which may be formed into the top of the lid 104 and includes a drain slot 122, opposed sides 124, and a trough 126. The trough 126 is an elongated downward slope constructed from the front of the lid to the back of the lid, terminating in the drain slot 122. The drain slot 122 is located proximate to the back of the lid 104 and open to the tray 102 below to allow condensate to flow from the drain channel into the tray. The opposed sides 124 of the drain channel, slope inward toward the trough 126. The opposed sides 124 and the trough 126 operate to collect condensate from the lid 104 and conduct it to the drain slot 122 into the tray 102.

Figure 4:
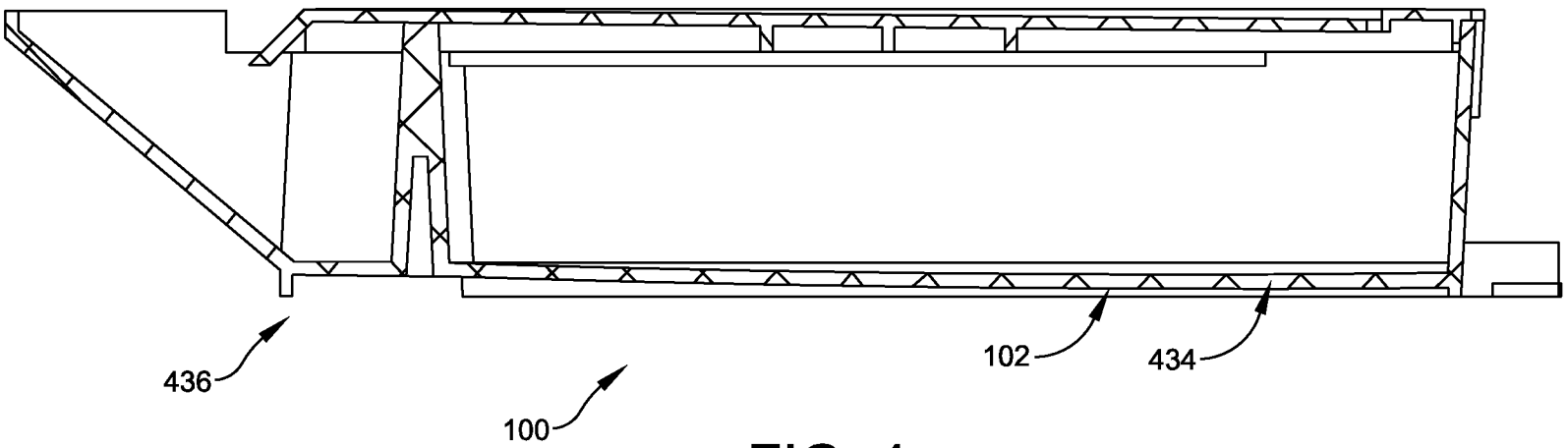
FIG. 4 is a cross sectional view of the system for a condensate collection device in FIG. 3 taken along line 4-4.

FIG. 4 provides a cross sectional view of structures discussed in detail supra, associated with FIGS. 1, 2, and 3 for the condensate collection device 100. FIG. 4 also illustrates a tray base ramp 434 configured to allow condensate contained in the tray 102, to flow toward the exit port 228, while allowing the outer surface of the base of the tray 102 to remain level. As illustrated in FIG. 4, the tray base ramp 434 has a slope from the front wall to the back wall of the tray 102, yet the outer surface of the base of the tray is constructed to remain level to any adjacent surface. It should be appreciated, based on the location of one or more exit ports 228 the construction and geometry of the tray base ramp 434 will vary based on application. To allow the outer surface of the base of the tray 102 to remain level one or more tray base leveling beams 436 may be included to provide additional structural support and leveling to the tray 102. While FIG. 4 illustrates one tray base leveling beam 436 a plurality may be used determined by the geometry of the tray 402. Various embodiments for tray base leveling beams 436 may exist. Various height tray base leveling beams 436 may be used on a single tray 102 and may be pre-cut and able to be "broken away" either partially to create various height, or completely to remove the lug, by an end user as necessary for a particular application thereby allowing configurability for multiple applications.

Figure 4A:
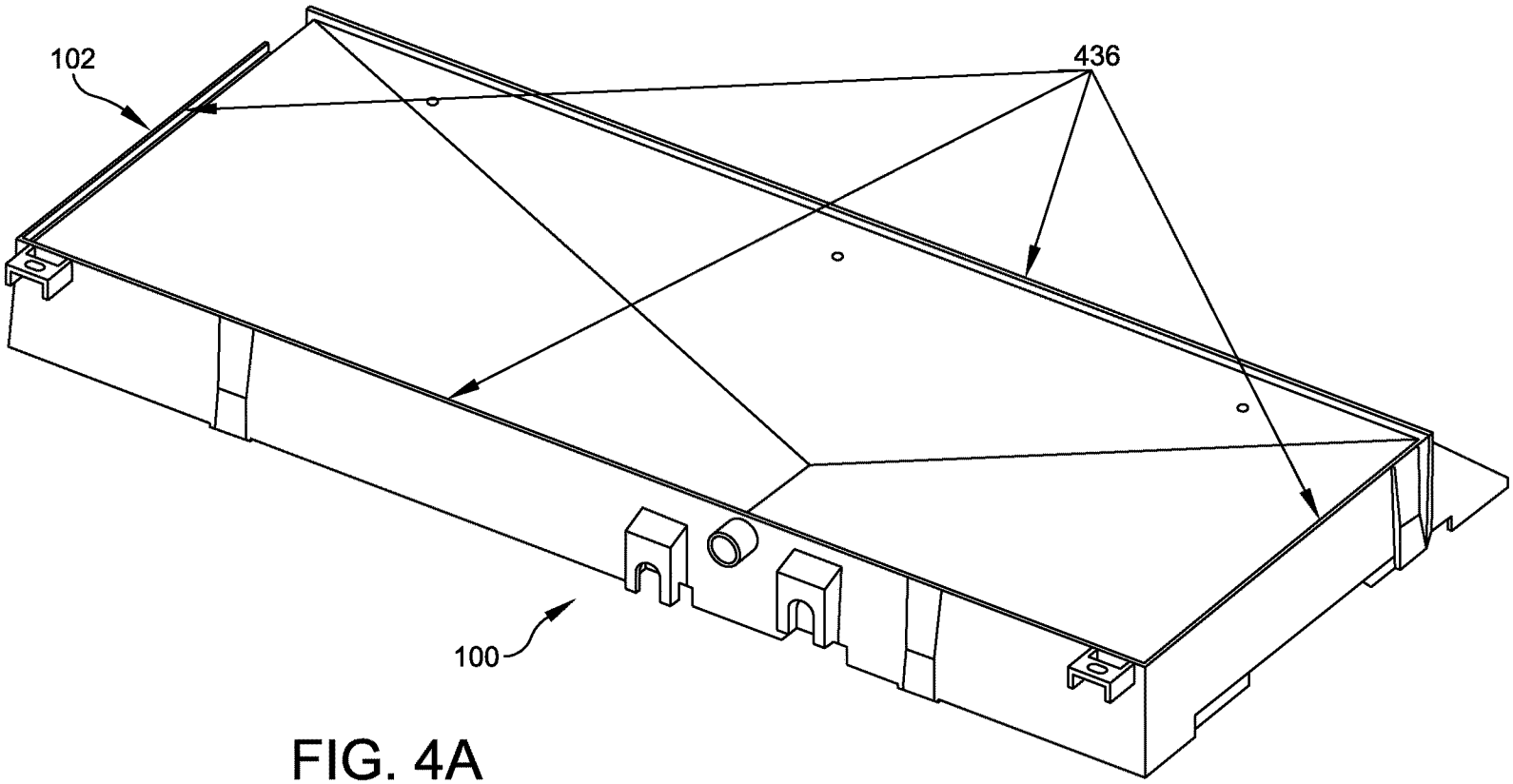
FIG. 4A is a bottom view of the system for a condensate collection device of FIG. 1

FIG. 4A is a bottom perspective view of the condensate collection device 100 showing a plurality of tray base leveling beams 436 disposed on each side of the base of the tray 102. Individual tray base leveling beams 436 may vary in height along each individual beam to maintain level contact to the air conditioner structure the tray 102 is mounted to. It should be appreciated the base leveling beams 436 are also configured to maintain the structural integrity of the tray 102 as when filled with condensate, the weight of the tray may be significant. To retain an amount of condensate without concern over rupture, tray base leveling beams 436 may provide additional stiffening support. It should be appreciated; embodiments in the construction of the tray base leveling beams 436 are varied based on the application. Other structures noted in FIG. 4A are detailed supra as part of FIG. 4.

Figure 5:
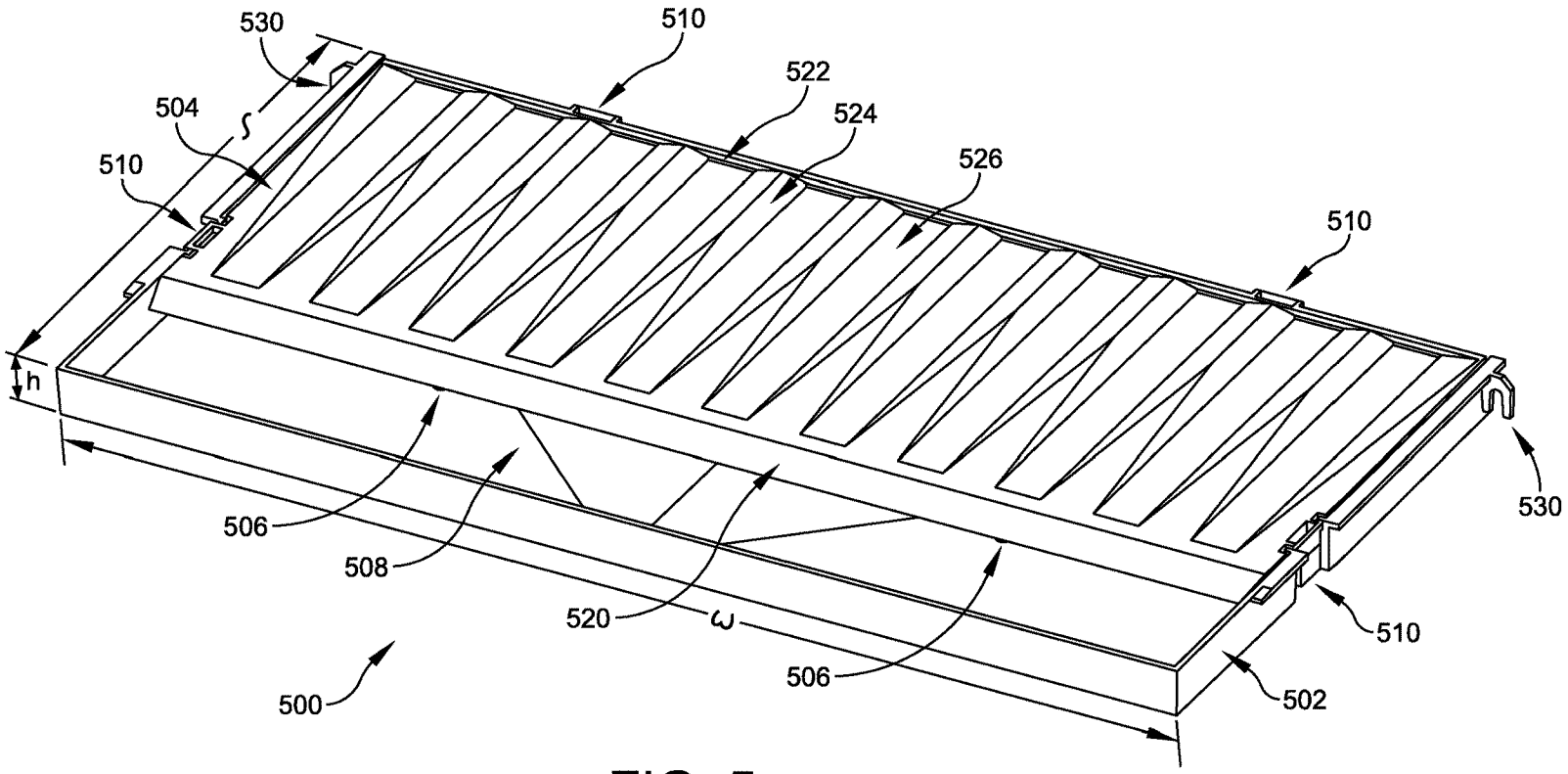
FIG. 5 is a perspective view of a system for a condensate collection device in accordance with an alternate embodiment of the invention.

FIG. 5 illustrates a perspective view of an alternate embodiment of a condensate collection device 500 analogous to the device 100 described above with reference to FIG. 1. The device 500 includes, a tray 502, a lid 504, a plurality of standoffs 506, a lid drain mouth 508, a tray latch assembly 510, a drain ramp 520, a tray frame mount 530 and drain channels including a drain slot 522, opposed sides 524, and a trough 526. In embodiments various geometries of the tray 502 and lid 504 varying the width w, length l, and height h of the condensate collection device 100 may be provided. Further the dimensions and number of the condensate drain channels disposed on the lid 504 are various as are the tray frame mount 530 structures and locations.

In various embodiments the front wall of the tray 502 is substantially perpendicular to the base of the tray 502. Further, the base of the tray 502 may be contoured to convey condensate toward one or more exit ports (not shown). The device 500 does not include entrance ports disposed on the lid 504 like the entrance ports 112 in the device 100. As described below, in one embodiment, the device 500 is installed in an air conditioner system without other condensate collection devices positioned above it.

Figure 6:
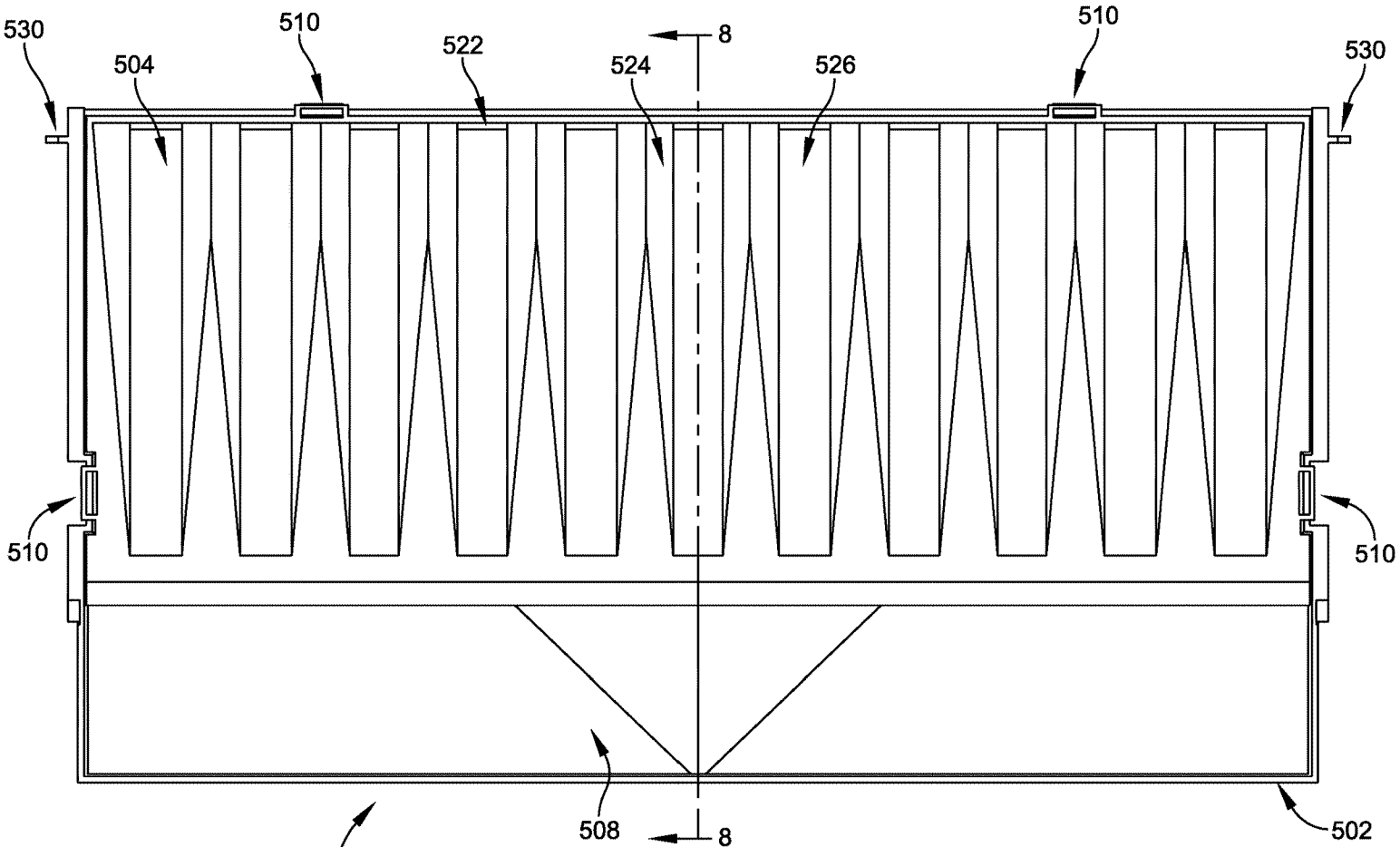
FIG. 6 is a top view of a system for a condensate collection device in accordance with an alternate embodiment of the invention.

FIG. 6 provides a top view of the condensate collection device 500 showing the tray 502, the lid 504, the lid drain mouth 508, the tray latch assembly 510, the tray frame mount 530 and the condensate drain channel including the drain slot 522, opposed sides 524, and the trough 526.

Figure 7:
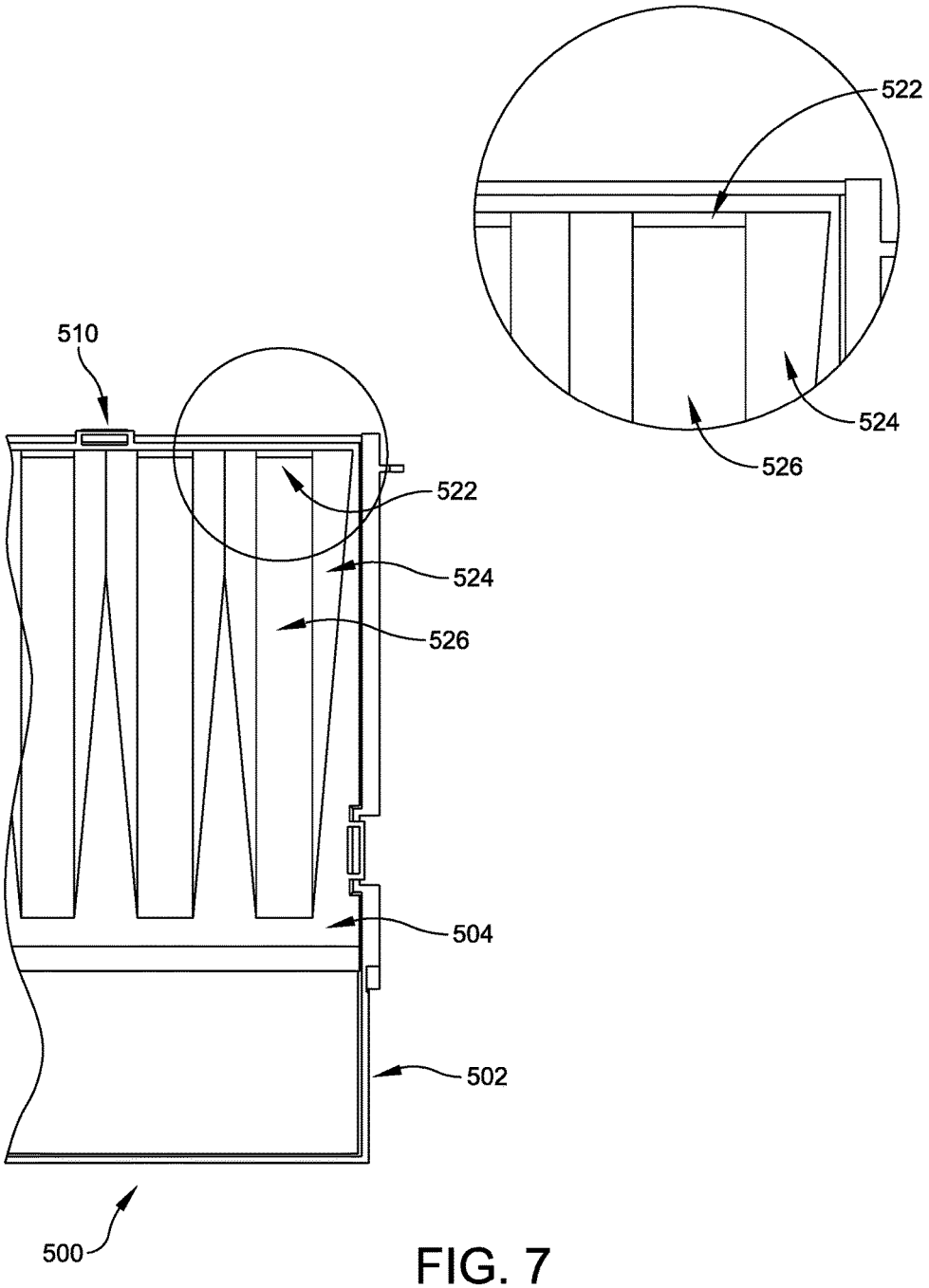
FIG. 7 is an exploded detail view of the system for a condensate collection device of FIG. 6.

FIG. 7 provides an exploded top view of the condensate collection device 500 showing the tray latch assembly 510 configured to operatively connect the tray 502 to the lid 504. Further detail is also provided for the condensate drain channel which may be formed into the top of the lid 504 and includes a drain slot 522, opposed sides 524, and a trough 526. These structures are analogous to those described in detail above for device 100 and with reference to FIG. 3.

Figure 8:
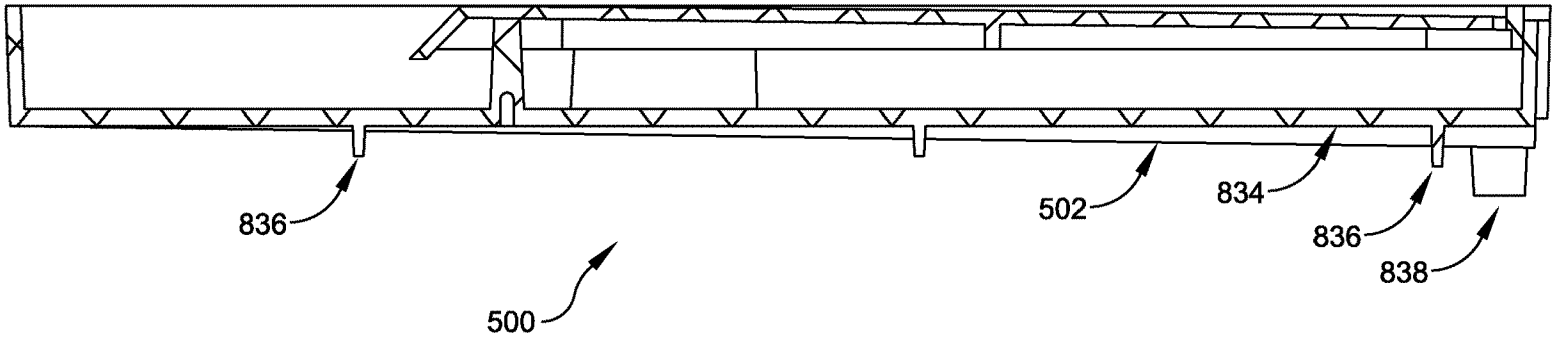
FIG. 8 is a cross sectional view of the system for a condensate collection device in of FIG. 5 taken along line 8-8.

FIG. 8 provides a cross sectional view of the condensate collection device 500. FIG. 8 shows a gravity assist exit port 838 formed into the tray 502. While FIG. 8 illustrates one gravity assist exit port 838, one or more may be disposed in the base of the tray 502 to accommodate a particular application of draining condensate and the shape of the tray base ramp 834. While FIG. 8 illustrates a gravity assist exit port 838 formed near the back wall of the tray 502, various embodiments may allow for the gravity assist exit port 838 to be located in other locations in the base of the tray 502. It should also be appreciated the shape of the gravity assist exit port 838 may vary based on the type of drain connection to the gravity assist exit port 838. Various embodiments may allow for a ridged, tapered, or straight contour for the gravity assist exit port 838 depending on the type of connection desired. It should be appreciated wide variability exists in connection types and media for draining condensate from the tray 502.

Figure 8A:
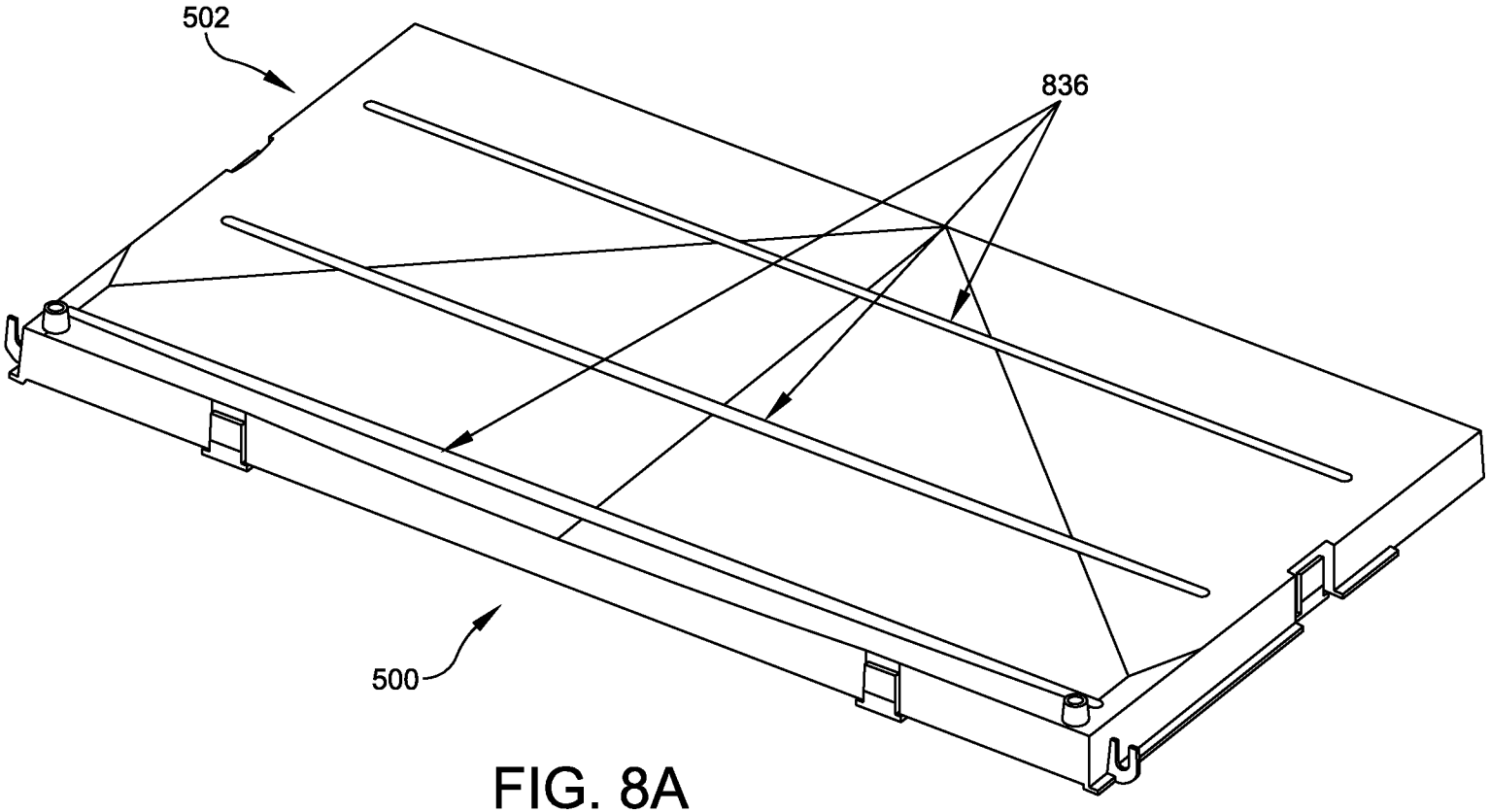
FIG. 8A is a bottom view of the system for a condensate collection device of FIG. 5.

FIG. 8A is a bottom perspective view of the device 500 showing three tray base leveling beams 836 disposed along the length of the base of the tray 502. It should be appreciated one of more base leveling beams 836 may be disposed on the base of the tray 502. Individual tray base leveling beams 836 may vary in height along each individual beam to maintain level contact to the air conditioner structure the tray 502 is mounted to. It should be appreciated the base leveling beams 836 are also configured to maintain the structural integrity of the tray 502 as when filled with condensate, the weight of the tray may be significant. To retain an amount of condensate without concern over rupture, tray base leveling beams 836 may provide additional stiffening support.

Figure 9:
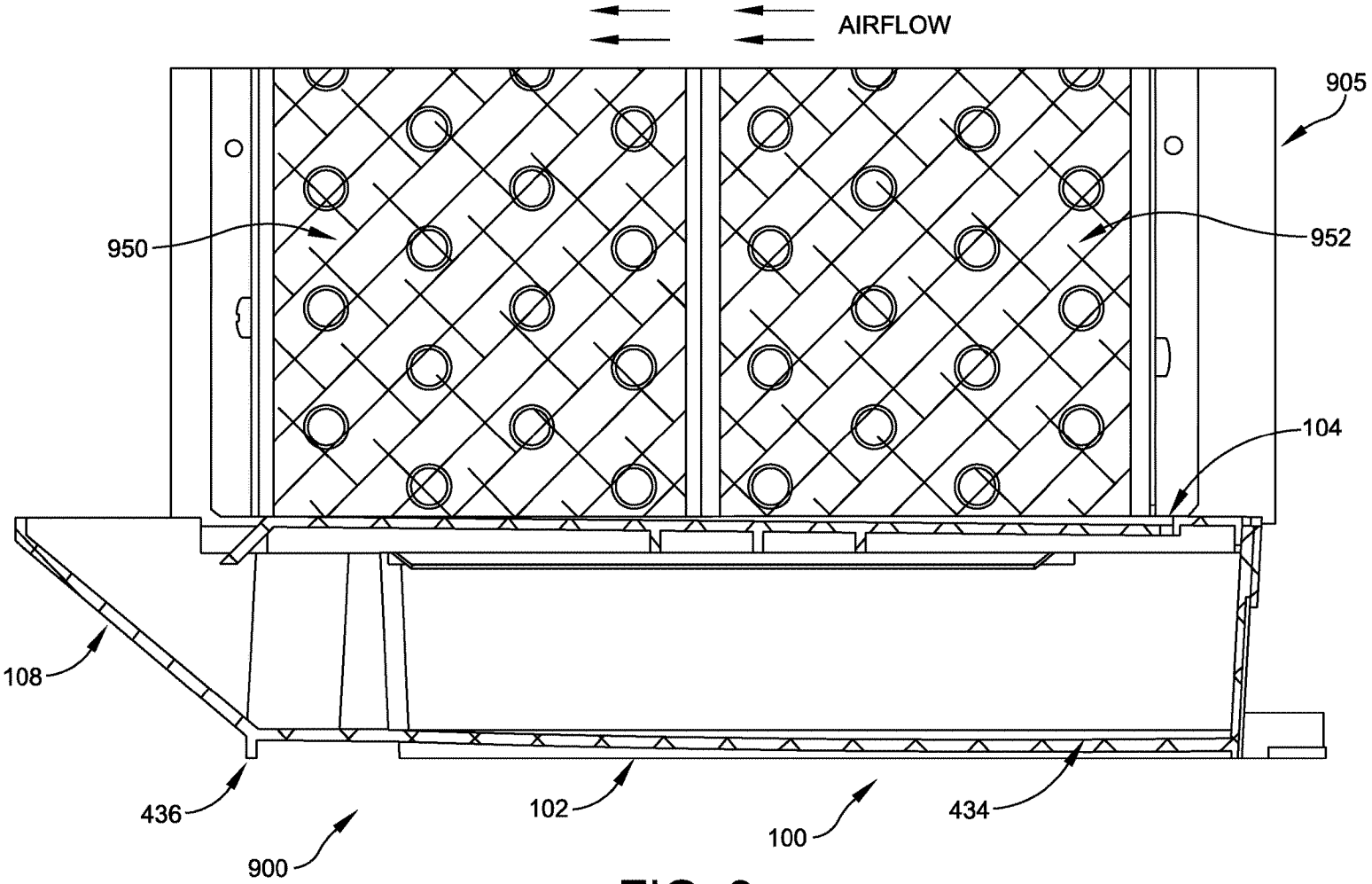
FIG. 9 is a cross sectional view of a system for a condensate collection device in accordance with an embodiment of the invention.

FIG. 9 illustrates a partial cross sectional view of an embodiment of an air conditioner 900 containing the condensate collection device 100 and a coil assembly 905. I In FIG. 9, the coil assembly 905 is a lower coil assembly. It should be appreciated such coil assemblies may be air driven, liquid driven, or other media driven to facilitate cooling. The coil assembly 905 includes a left lower coil assembly 950, and a right lower coil assembly 952. It should be appreciated, each coil assembly may be air driven, liquid driven, other media driven, have a single unified coil assembly, or contain no coil assembly at all.

It should be appreciated; the various configurations of coil assemblies described are contemplated in principles of the invention. In exemplary embodiments as warmer intake air enters into the entering air side of the right lower coil assembly 952 (indicated by "AIRFLOW" in FIG. 9), air is blocked by the tray 102 and lid 104 from entering under the right lower coil assembly 952. As the air flow continues from the right lower coil assembly 952 to the left lower coil assembly 950 air remains within the coil assemblies and is unable to mix with any non-conditioned air until leaving the leaving air side. This prevents any further condensate from forming at a location internal to the air conditioner that may not be desirable, and improve the overall efficiency of the air conditioner itself. Further, if no air coil assembly exists; warmer air from the air entering side will continue to move to the air leaving side of the left lower coil assembly 950 and condensate will still fall onto the lid 104 or lid drain mouth 108.

In at least some embodiments, the left lower coil assembly 950, and the right lower coil assembly 952 are mounted adjacent to and in close proximity with the tray 104 of the condensate collection device. This close proximity configuration allows any condensate flowing from the left lower coil assembly 950, and the right lower coil assembly 952 to drain directly onto the lid 104, the lid drain mouth 108, or lid drain ramp 120. Further, as illustrated by FIG. 9, the condensate collection device assembly is configured as an air blocking mechanism by preventing warm intake air (from the entering air side) from entering below the lower coil assemblies 950, 952. Any warm intake air from the entering air side must travel around the back wall of the tray and across the lower coil assemblies 950, 952. This configuration will both reduce condensate by not allowing warm intake from the entering air side to mix with cooler conditioned air from the exiting air side and increase efficiency of the air conditioning unit by keeping the cooler conditioned air at a lower temperature as it will not mix with warmer air. It should also be appreciated that the coil header port 118 and coil frame port 132 discussed supra may accept a portion of the coil assembly or coil frame housing to drain directly into the tray 104 to prevent any leaking of condensate.

As condensate is collected from the lower coil assemblies 950, 952 into the tray 104, the tray base ramp 434, and tray base leveling beams 436 together serve to conduct the condensate to the exit port 228. It should be appreciated the tray base ramp 434 is a structure internal to the tray 104, while the tray base leveling beams 136 is a structure on the outside of the tray 104. From the exit port the condensate may be pumped into any general purpose building drain or disposed of in any way the operator of the equipment sees fit for the application.

Figure 10:
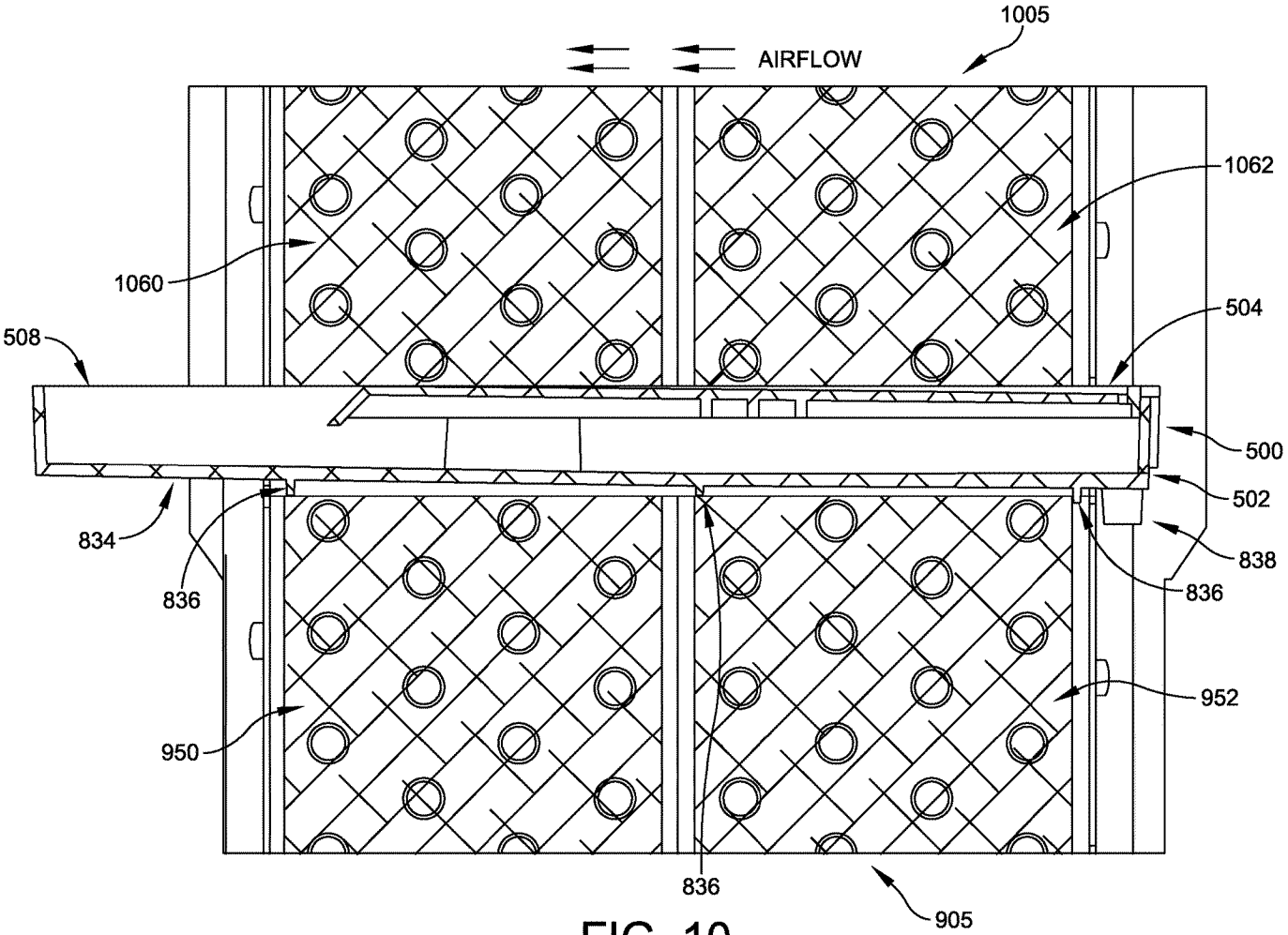
FIG. 10 is a cross sectional view of a system for a condensate collection device in accordance with an embodiment of the invention.

FIG. 10 illustrates another partial cross sectional view of the air conditioner 900 showing the condensate collection device 500 and the associated coil assembly 905. The gravity assist exit port 538 is configured to conduct condensate contained in the tray 502 to the condensate collection device 100 the condensate may be or pumped into any general purpose building drain or disposed of in any way the operator of the equipment sees fit for the application.

As shown in FIG. 10, the air conditioner 905 also includes a two part upper coil assembly 1005, having a left upper coil assembly 1060, and a right upper coil assembly 1062. It should be appreciated, each coil assembly may be air driven, liquid driven, other media driven, have a single unified coil assembly, or contain no coil assembly at all. These upper coil assemblies 1060, 1062 may be configured adjacent to the lower coil assemblies 950, 952. This orientation may include the upper coil assemblies 1060, 1062 mounted adjacent and above the lower coil assembly 950, 952 with the condensate collection device 500 between the two coil assemblies in close proximity as shown in FIG. 10.

This close proximity configuration allows any condensate flowing from the upper coil assembly 1060 to drain directly onto the lid 504, the lid drain mouth 508, or lid drain ramp 520. Further, as illustrated by FIG. 10, the condensate collection device assembly is configured as an air blocking mechanism preventing warm intake air from the entering air side from entering below the upper coil assemblies 1060, 1062 or above the lower coil assembly 950, 952. Any warm intake air from the entering air side must travel around the back wall of the tray 504 and across either the upper coil assemblies 1060, 1062 or lower coil assemblies 950, 952. This configuration will both reduce condensate by not allowing warm intake air from the entering air side to mix with cooler conditioned air from the leaving air side and increase efficiency of the air conditioning unit by keeping the cooler conditioned air at a lower temperature as it will not mix with warmer air.

It should be appreciated; the various configurations of coil assemblies described are contemplated in principles of the invention. Exemplary embodiments demonstrate as warmer intake air enters into the "air entering side" of the right lower coil assembly 952 (indicated by "AIRFLOW" in FIG. 10), air is blocked by the tray 502 and lid 504 from entering under the right lower coil assembly 952. As the air flow continues from the right lower coil assembly 952 to the left lower coil assembly 950 air remains within the coil assemblies and is unable to mix with any non-conditioned air until leaving the "air leaving side." This prevents any further condensate from forming at a location internal to the air conditioner that may not be desirable, and improve the overall efficiency of the air conditioner itself. Further, if no air coil assembly exists; warmer air from the air entering side will continue to move to the air leaving side of the left lower coil assembly 950 and condensate will still fall onto the lid 504 or lid drain mouth 508.

As condensate is collected from the upper coil assemblies 1060, 1062 into the tray 504, the tray base ramp 834, and tray base leveling beams 836 serve to conduct the condensate to the gravity assist exit port 838. The gravity assist exit port 838 is configured to conduct condensate contained in the tray 502 to another condensate collection device embodied herein, generic in nature, or pumped into any general purpose building drain or disposed of in any way the operator of the equipment sees fit for the application.

It should be appreciated the geometry of the condensate collection assembly geometry may have an effect on cooling efficiency. As overall height of one of more condensate collection assembly increases in a fixed height cabinet, less coil assembly operational area may become available for cooling operations.

Figure 11:
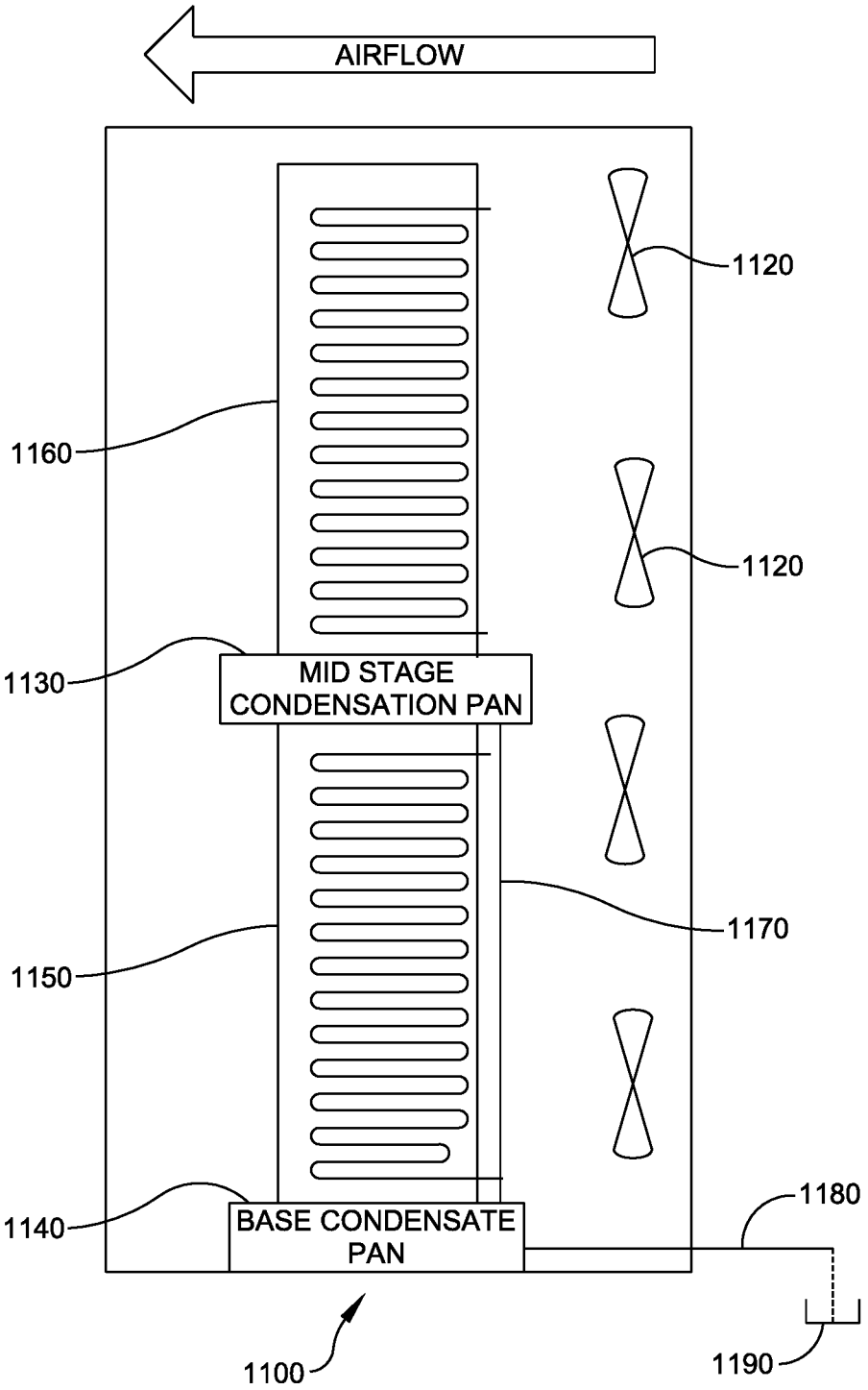
FIG. 11 is a schematic representation of a cooling unit in accordance with an embodiment of the invention.

FIG. 11 illustrates an air conditioning unit 1100 having one or more fan assemblies 1120 of various types to propel air across the cooling coil assemblies contained within the air conditioning unit 1100. As illustrated in FIG. 11, an upper coil assembly 1160 and a lower cooling coil assembly 1170 may exist (FIG. 11 illustrates a monolithic upper and lower cooling coil assembly), each with an associated condensate collection device 1130, 1140. A condensate collection device located adjacent to and between the upper coil assembly 1160 and a lower cooling coil assembly 1150 may exist and be configured to collect condensate as detailed supra from the upper coil assembly 1160. This "Mid Stage Condensate Pan" 1130 may also be configured to block warm intake air from the entering air side from avoiding the upper coil assembly 1160 and a lower cooling coil assembly 1170. A second "Base Condensate Pan" 1140 condensate collection device may be located adjacent to and below the lower cooling coil assembly 1150 and configured to collect condensate as detailed supra from the lower coil assembly 1150.

As condensate from the upper coil assembly 1160 forms and enters the mid stage condensate collection device 1130, condensate flows from the mid stage condensate collection device 1130 to the second condensate collection device 1140. Condensate is conducted through a condensate drain tube 1170, which is operatively connected from the gravity assist exit port 1038 of the mid stage condensate collection device 1130 to the entrance port 112 of the second base condensate collection device 1140. As the second condensate collection device 1140 fills with condensate both from the mid stage condensate collection device 1130 and the lower coil assembly 1150, condensate is conducted to a general purpose drain 1190, through a drain hose 1180. It should be appreciated the general purpose drain 1190 and drain hose 1180, are well known in the state of the art and have wide variation and application.

In one embodiment, the mid stage condensate collection device 1130 may be implemented using the device 500 described above, and configured adjacent the coils as shown in FIG. 10. Also, in one embodiment, the second base condensate collection device may be implemented using the device 100 described above, and configured adjacent the coils as shown in FIG. 9.

Principles of the invention demonstrate that while two coil assemblies are illustrated in FIG. 11, one or more may be used. A single coil and condensate collection device may be used or a plurality based on the application and particular air conditioner system.

Having thus described several aspects of at least one embodiment of this invention, it is to be appreciated various alterations, modifications, and improvements will readily occur to those skilled in the art. Such alterations, modifications, and improvements are intended to be part of this disclosure, and are intended to be within the spirit and scope of the invention. Accordingly, the foregoing description and drawings are by way of example only.

What is claimed is:

1. An air conditioner comprising:

a first air conditioner coil assembly configured to cool air;

a first condensate collection device including:

a first tray configured to be mounted in a horizontal orientation below the first air conditioner coil assembly to collect condensate, the first tray including a rectangular shape having a width, a length, and a height to create a volume within the first tray to contain condensate produced by the first air conditioner coil assembly; and a first lid configured to restrict air movement across the first air conditioner coil assembly, the first lid including a condensate drain channel configured to collect and drain condensate from a top of the first lid into the first tray, and a coil header port configured to accept a portion of the first air conditioner coil assembly, the first lid including a rectangular shape having a width and a length that corresponds to the width and the length of the first tray;

a second air conditioner coil assembly disposed below the first condensate collection device and configured to cool air; and a second condensate collection device including:

a second tray configured to be mounted in a horizontal orientation below the second air conditioner coil assembly to collect condensate; and a second lid configured to restrict air movement across the second air conditioner coil assembly, the second lid including a condensate drain channel configured to collect and drain condensate from a top of the second lid into the second tray, and a coil header port configured to accept a portion of the second air conditioner coil assembly.

2. The air conditioner of claim 1, wherein the first condensate collection device further includes a coil frame port configured to accept a portion of a housing of the first air conditioner coil assembly.

3. The air conditioner of claim 1, wherein the first condensate collection device further includes a plurality of standoffs disposed between the first tray and the first lid, wherein the first lid is supported by the first tray and the plurality of standoffs.

4. The air conditioner of claim 1, wherein the second condensate collection device further includes a coil frame port configured to accept a portion of a housing of the second air conditioner coil assembly.

5. The air conditioner of claim 1, wherein the second condensate collection device further includes a plurality of standoffs disposed between the second tray and the second lid, wherein the second lid is supported by the second tray and the plurality of standoffs.

6. The air conditioner of claim 1, further comprising a condensate drain channel fluidly connected between the first condensate collection device and the second condensate collection device.

7. The air conditioner of claim 1, wherein the width and the length of the first tray corresponds to a width and a length of the first air conditioner coil assembly to capture condensate produced by the first air conditioner coil assembly.

8. The air conditioner of claim 1, wherein the second tray of the second condensate collection device includes a rectangular shape having a width, a length, and a height to create a volume within the second tray to contain condensate produced by the second air conditioner coil assembly, and wherein the second lid of the second condensate collection device includes a rectangular shape having a width and a length that corresponds to the width and the length of the second tray of the second condensate collection device.

9. The air conditioner of claim 1, wherein the width and the length of the second tray of the second condensate collection device correspond to a width and a length of the second air conditioner coil assembly to capture condensate produced by the second air conditioner coil assembly.

* * * * *